US010472807B2

(12) United States Patent
McFarlane

(10) Patent No.: US 10,472,807 B2
(45) Date of Patent: Nov. 12, 2019

(54) PREVENTION OF FREEZING OF OUTDOOR WATER LINE

(71) Applicant: Merdick Earl McFarlane, Providence Bay (CA)

(72) Inventor: Merdick Earl McFarlane, Providence Bay (CA)

( * ) Notice: Subject to any disclaimer, the term of this patent is extended or adjusted under 35 U.S.C. 154(b) by 467 days.

(21) Appl. No.: 15/171,258

(22) Filed: Jun. 2, 2016

(65) Prior Publication Data

US 2017/0350098 A1 Dec. 7, 2017

(51) Int. Cl.
*E03B 7/12* (2006.01)

(52) U.S. Cl.
CPC ..... *E03B 7/12* (2013.01); *Y10T 137/1189* (2015.04); *Y10T 137/1244* (2015.04); *Y10T 137/1353* (2015.04)

(58) Field of Classification Search
CPC ..... E03B 7/12; E03B 7/10; Y10T 137/1189; Y10T 137/1353; Y10T 137/1244
See application file for complete search history.

(56) References Cited

U.S. PATENT DOCUMENTS

| | | | | |
|---|---|---|---|---|
| 3,380,533 | A | 4/1968 | Andrew | |
| 3,880,180 | A | 4/1975 | Wismer | |
| 4,248,177 | A | 2/1981 | Peterson et al. | |
| 4,256,258 | A | 3/1981 | Sekiya | |
| 4,286,613 | A | 9/1981 | Lacoste | |
| 4,481,966 | A | 11/1984 | Anderson | |
| 4,635,668 | A | 1/1987 | Netter | |
| 4,657,038 | A | 4/1987 | Lyons | |
| 5,014,752 | A * | 5/1991 | Takenakajima | E03B 7/12 138/148 |
| 5,113,892 | A | 5/1992 | Hull et al. | |
| 5,220,937 | A | 6/1993 | Roberts et al. | |
| 5,622,207 | A | 4/1997 | Frank | |
| 6,196,246 | B1 | 3/2001 | Folsom | |
| 6,317,051 | B1 | 11/2001 | Cohen | |

(Continued)

FOREIGN PATENT DOCUMENTS

| | | |
|---|---|---|
| CN | 201794114 | 4/2011 |
| CN | 201983828 | 9/2011 |

(Continued)

OTHER PUBLICATIONS

Chemical Engineering Progress Oct. 1997 "Winter's Coming—Use Freeze Protection Valves to Keep Lines Flowing" Nick Tallos.

(Continued)

*Primary Examiner* — Eric Keasel
*Assistant Examiner* — Kevin R Barss

(57) ABSTRACT

An apparatus includes a first processor-controllable valve and a second processor-controllable valve both of which are connectable to an outdoor water line. A controller configured to control the operation of the first processor-controllable valve and the second processor-controllable valve. The controller, in use, urges the second processor-controllable valve to open and permit flow of the water along an interior of the outdoor water line for the case where the second electrical power source is available for use by the second processor-controllable valve when the first electrical power source is unavailable for use by the first processor-controllable valve.

20 Claims, 4 Drawing Sheets

(56) References Cited

U.S. PATENT DOCUMENTS

| | | | | |
|---|---|---|---|---|
| 6,763,845 | B2 | 7/2004 | Hoggard | |
| 7,701,356 | B2 | 4/2010 | Curt et al. | |
| 7,710,282 | B1 | 5/2010 | Young | |
| 8,120,308 | B2 * | 2/2012 | Ward | B60L 8/003 320/101 |
| 8,174,398 | B2 | 5/2012 | Wien | |
| 8,196,602 | B2 | 6/2012 | Korzeniowski | |
| 8,439,062 | B1 * | 5/2013 | Ziegenbein | E03B 7/071 137/15.11 |
| 8,833,384 | B2 | 9/2014 | Burt | |
| 2005/0188758 | A1 | 9/2005 | Yekutiely et al. | |
| 2010/0132803 | A1 | 6/2010 | Fima | |
| 2011/0114202 | A1 | 5/2011 | Goseco | |
| 2013/0289878 | A1 | 10/2013 | Kim et al. | |
| 2014/0000724 | A1 | 1/2014 | Park | |
| 2014/0167503 | A1 * | 6/2014 | Redpath | H02J 9/06 307/23 |
| 2014/0261693 | A1 | 9/2014 | Geerligs et al. | |
| 2015/0180275 | A1 * | 6/2015 | Tomassi | H02J 9/06 307/64 |
| 2015/0211510 | A1 | 7/2015 | Walsh et al. | |

FOREIGN PATENT DOCUMENTS

| | | |
|---|---|---|
| CN | 202383503 | 8/2012 |
| CN | 203639991 | 6/2014 |
| CN | 103939748 | 7/2014 |
| CN | 103279158 | 12/2014 |
| CN | 104655309 | 5/2015 |
| DE | 102008023239 | 11/2009 |
| EP | 0942274 | 9/1999 |
| WO | 2007011082 | 1/2007 |

OTHER PUBLICATIONS

Columbia Basin Water Smart "Winter Bleed Practices: Options for Preventing Frozen Municipal Water Lines" retrieved from http://cbtwatersmart.org/ Jun. 18, 2016.

Dave Smith, Texas Instruments "An introduction to MSP430TM microcontroller-based temperature-sensing solutions" Jan. 2013.

InspectAPedia Well or Lake Water Pipe Freeze Protection retrieved from http://inspectapedia.com/water/Snifter_Valve.php Jun. 18, 2016.

Manitoba Water Use Efficiency Program Nov. 1996 "Preventing Frozen Water Pipes" retrieved from http://www.gov.mb.ca/conservation/pub-archive/publs96/bul9614e.html Jun. 18, 2016.

Mark Buttle and Michael Smith "Out in the Cold" 2004, Chapter 3 "Water Supply".

Sensors "Smart Pipes—Instrumented Water Pipes, Can This Be Made a Reality?" retrieved from www.mdpi.com/journal/sensors Jun. 18, 2016.

ThermOmegaTech "Basics of Freezing" retrieved from valves@thermomegatech.com Jun. 18, 2016.

* cited by examiner

PREVENTION OF FREEZING OF OUTDOOR WATER LINE

TECHNICAL FIELD

This document relates to the technical field of (and is not limited to) an apparatus for the prevention or avoidance, at least in part, of freezing of water positioned in an outdoor water line (and method therefore).

BACKGROUND

Frozen water pipes are inconvenient and costly to repair, whether for domestic or industrial applications. There are existing systems configured for preventing frozen pipes and/or thawing pipes that are already frozen, in which the existing systems have some drawbacks associated with them.

SUMMARY

Since some water pipes are located either outside (of a building) or in unheated areas (within a building) where the ambient temperature may occasionally drop below the freezing point of water, any water positioned in the pipework may potentially freeze. When water freezes, it expands due to negative thermal expansion, and this expansion may cause failure of a pipe system.

Pipe insulation may not prevent the freezing of standing water in pipework. Moreover, pipe insulation may increase the time required for freezing to occur, thereby reducing the risk of pipes becoming frozen. For this reason, it is recommended to insulate the pipework at risk of freezing. It will be appreciated that local water-supply regulations may require pipe insulation (thermal insulation) be applied to pipework to reduce the risk of pipe freezing.

For a given length, a smaller-bore pipe holds a smaller volume of water than a larger-bore pipe. Therefore, water in the smaller-bore pipe may freeze more easily (and more quickly) than water in the larger-bore pipe (presuming equivalent environments). Since the smaller-bore pipe presents a greater risk of freezing, thermal insulation (pipe insulation) may be used in combination with alternative methods of freeze prevention (e.g., installation of a heating cable along the water pipe, and/or ensuring a consistent flow of water through the water pipe, etc.). However, water pipes continue to fail simply because the existing system fail to prevent the occurrence of frozen water pipes.

It will be appreciated that there exists a need to mitigate (at least in part) at least one problem associated with the freezing of water located in an outdoor pipe (also called the existing technology). After much study of the known systems and methods with experimentation, an understanding of the problem and its solution has been identified and is articulated as follows:

Some existing systems (for the prevention or avoidance of freezing of outdoor water lines) use a water valve connected with the outdoor water pipe (also called a water line). However, when the electrical power supply for the water valve fails to operate the water valve, and the temperature of the water approaches the freezing temperature, the water located in the outdoor water pipe may inadvertently freeze, leading to unwanted damage, etc. (which is an undesirable result).

For instance, to resolve this situation, what is needed is a back-up valve for the water valve, so that the back-up valve operates when the water valve cannot operate.

To mitigate, at least in part, at least one problem associated with the existing technology, there is provided (in accordance with a major aspect) an apparatus. The apparatus includes (and is not limited to) a first processor-controllable valve configured to be operative in response to the controlled application of a first electrical power source thereto (that is, connecting the first electrical power source to the first processor-controllable valve so that the first processor-controllable valve may be energized or activated). The first processor-controllable valve is also configured to be fluidly connectable to an outdoor water line, in which the outdoor water line is configured to convey water therealong (that is, water is conveyable along the interior of the outdoor water line). A second processor-controllable valve is configured to be operative in response to the controlled application of a second electrical power source thereto (that is, connecting the second electrical power source to the second processor-controllable valve so that the second processor-controllable valve may be energized or activated). The second processor-controllable valve is also configured to be fluidly connectable to the outdoor water line. A controller is configured to determine whether the water positioned in the outdoor water line is reaching the freezing temperature (of water). The controller is also configured to control the operation of the first processor-controllable valve and the second processor-controllable valve depending on whether the first electrical power source is available and whether the water positioned in the outdoor water line has reached the freezing temperature of water.

Other aspects are identified in the claims.

Other aspects and features of the non-limiting embodiments may now become apparent to those skilled in the art upon review of the following detailed description of the non-limiting embodiments with the accompanying drawings.

This Summary is provided to introduce concepts in simplified form that are further described below in the Detailed Description. This Summary is not intended to identify key features or essential features of the disclosed or claimed subject matter, and is not intended to describe each disclosed embodiment or every implementation of the disclosed or claimed subject matter, and is not intended to be used as an aid in determining the scope of the claimed subject matter. Many other novel advantages, features, and relationships will become apparent as this description proceeds. The figures and the description that follow more particularly exemplify illustrative embodiments.

BRIEF DESCRIPTION OF THE DRAWINGS

The non-limiting embodiments may be more fully appreciated by reference to the following detailed description of the non-limiting embodiments when taken in conjunction with the accompanying drawings, in which.

Figure 1:
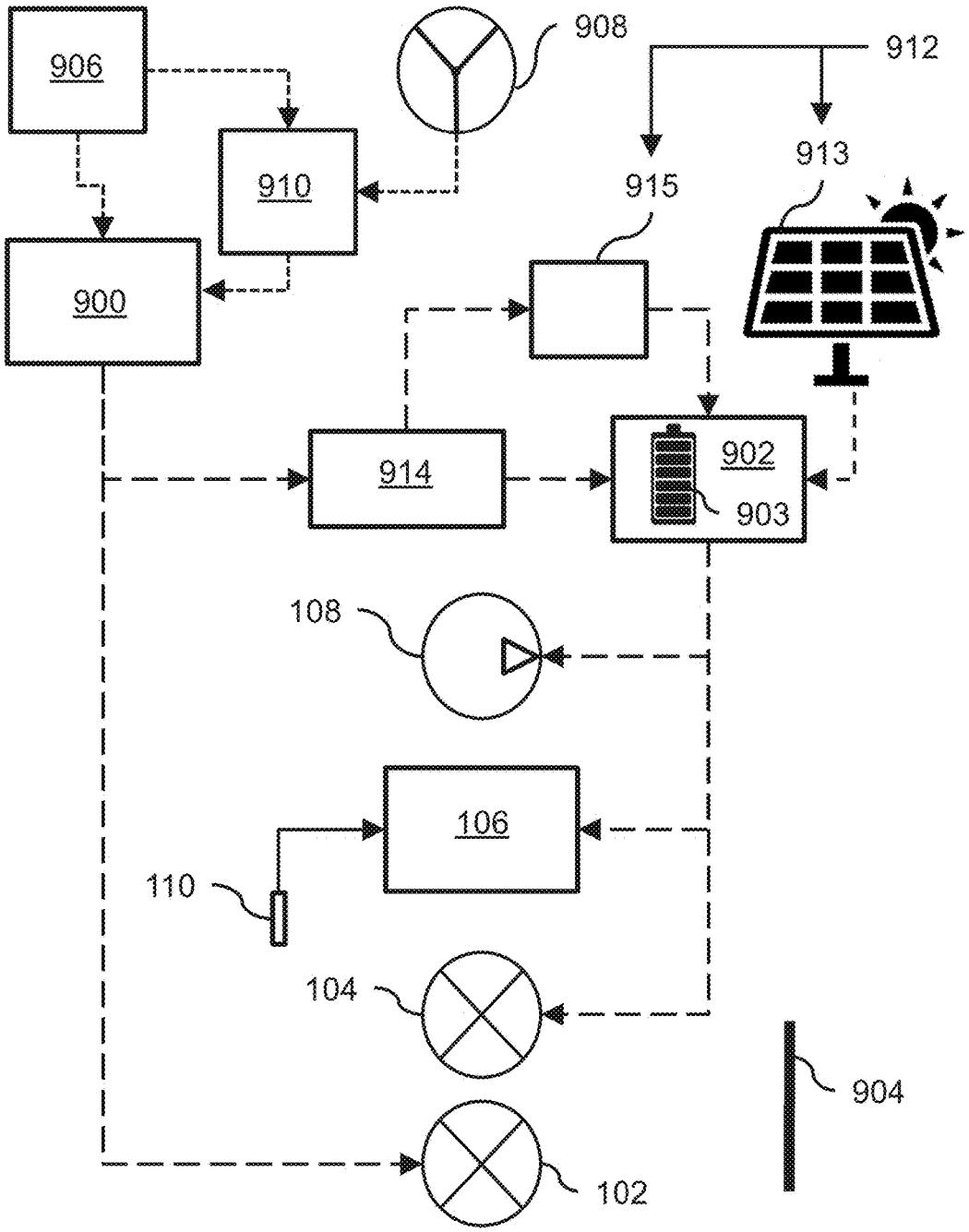
FIG. 1 (SHEET 1 of 4) depicts an embodiment of an electrical power distribution schematic of an apparatus including a first processor-controllable valve, a second processor-controllable valve and a controller.

The drawings are not necessarily to scale and may be illustrated by phantom lines, diagrammatic representations and fragmentary views. In certain instances, details unnecessary for an understanding of the embodiments (and/or details that render other details difficult to perceive) may have been omitted.

Corresponding reference characters indicate corresponding components throughout the several figures of the drawings. Elements in the several figures are illustrated for simplicity and clarity and have not been drawn to scale. The dimensions of some of the elements in the figures may be emphasized relative to other elements for facilitating an understanding of the various disclosed embodiments. In addition, common, but well-understood, elements that are useful or necessary in commercially feasible embodiments are often not depicted to provide a less obstructed view of the embodiments of the present disclosure.

LISTING OF REFERENCE NUMERALS USED IN THE DRAWINGS

102 first processor-controllable valve, or valve
104 second processor-controllable valve, or valve
106 controller, or computer
108 water pump, or pump
110 temperature sensor, or sensor
112 water meter, or meter
200 control method
202 first control operation
204 second control operation
206 third control operation
208 fourth control operation
210 fifth control operation
212 sixth control operation
214 seventh control operation
900 first electrical power source
902 second electrical power source
903 battery assembly
904 outdoor water line, or pipe, or line
905 portal
906 power grid
908 standby generator
910 standby-generator switch, or switch
912 battery charger
913 solar panel
914 automatic reverse voltage switch, or switch
915 electrical transformer
916 building
918 water source
920 water drain
922 frost line
924 soil
928 water inlet
930 water outlet
932 drain pipe

DETAILED DESCRIPTION OF THE NON-LIMITING EMBODIMENT(S)

The following detailed description is merely exemplary and is not intended to limit the described embodiments or the application and uses of the described embodiments. As used, the word "exemplary" or "illustrative" means "serving as an example, instance, or illustration." Any implementation described as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure. The scope of may be defined by the claims (in which the claims may be amended during patent examination after filing of this application). For the description, the terms "upper," "lower," "left," "rear," "right," "front," "vertical," "horizontal," and derivatives thereof shall relate to the examples as oriented in the drawings. There is no intention to be bound by any expressed or implied theory in the preceding Technical Field, Background, Summary or the following detailed description. It is also to be understood that the devices and processes illustrated in the attached drawings, and described in the following specification, are exemplary embodiments (examples), aspects and/or concepts defined in the appended claims. Hence, dimensions and other physical characteristics relating to the embodiments disclosed are not to be considered as limiting, unless the claims expressly state otherwise. It is understood that the phrase "at least one" is equivalent to "a". The aspects (examples, alterations, modifications, options, variations, embodiments and any equivalent thereof) are described regarding the drawings. It should be understood that the invention is limited to the subject matter provided by the claims, and that the invention is not limited to the particular aspects depicted and described.

FIG. 1 depicts an embodiment of an electrical power distribution schematic (view) of an apparatus including a synergistic combination of a first processor-controllable valve 102 (also called a first tap), a second processor-controllable valve 104 (also called a second tap) and a controller 106.

An embodiment of the first processor-controllable valve 102 includes a valve configured to be operated by a solenoid, which when powered by electrical current, the solenoid will open a gate style valve to allow the flow of water to occur. When the electrical current is lost by some means, the valve is configured to close and water stops flowing. The valve is configured to be controlled by a control module, a relay and a temperature sensor probe, etc. Preferably, the valve is configured to be powered by a 110 Volt AC source. An example of the valve is available from the AMAZON (STRADEMARK) on-line shop with a manufacturer reference of STK0114010075 and an ASIN number of B00R483AYE.

An embodiment of the second processor-controllable valve 104 includes a valve configured to be operated by a solenoid that when powered by electrical current is to open a gate style valve to allow the flow of water to occur. When the electrical current is lost by some means, the valve is configured to close and water stops flowing. The valves is configured to be controlled by a control module, a relay and a temperature sensor probe, etc. The valve is configured to be powered by a 12 Volt DC power source. An example of the valve is available from the AMAZON (STRADEMARK) on-line shop with a manufacturer reference number of STK0114010072 and an ASIN number of B00R2J9HCY.

An embodiment of the controller 106 includes a controller that is configured to execute (perform) a variety of applications within a set system. The controller is configured to measure the water temperature of the water held in the outdoor water line 904 (such as, a well, pipe or other potable water system). Using an internal computer program contained in the controller, a signal is set throughout the controller, a relay is activated when the water temperature reaches the pre-set freezing point, a tap is turned ON and water flows until the system is turned off, or the water temperature reaches an acceptable level of temperature to prevent freezing of the outdoor water line 904. The secondary system in the controller uses a telecommunications port to notify end users (via a telephone connection) that the internal temperature of the water within the outdoor water line 904 (whether buried or not buried) is set to freeze, and that precautions must be taken to monitor the controller and/or the apparatus. Preferably, the telecommunications system is a component to the controller. Preferably, the embodiment of the controller 106 includes the Model number X-301-1 controller manufactured by XYTRONIX RESEARCH & DESIGN, INC. (TRADENAME) based in Utah, USA.

The first processor-controllable valve 102 is also called a primary processor-controllable valve. The first processor-controllable valve 102 is configured to be operative in response to the controlled application of a first electrical power source 900 thereto (that is, connecting the first electrical power source 900 to the first processor-controllable valve 102 so that the first processor-controllable valve 102 may be energized or activated). The first electrical power source 900 is also called a primary power source, such as 120 volt AC (Alternating Current) mains power panel, etc. The first processor-controllable valve 102 is also configured to be fluidly connectable (either directly or indirectly) to an outdoor water line 904 (as depicted in any one of FIGS. 3 and 4), in which the outdoor water line 904 is configured to convey water therealong (that is, water is conveyable along the interior of the outdoor water line 904). The outdoor water line 904 may include a buried outdoor water line. The outdoor water line 904 may include a non-buried outdoor water line (an outdoor water line that is installed above ground). The outdoor water line 904 may include a combination of a buried outdoor water line and a non-buried outdoor water line. The outdoor water line 904 is a length of water line that is installed outdoors (that is, not installed in a building, such as a home, etc.). The outdoor water line 904 may be made of a suitable rugged, plastic material for outdoor usage, etc.

The second processor-controllable valve 104 is also called a standby processor-controllable valve. The second processor-controllable valve 104 is configured to be operative in response to the controlled application of a second electrical power source 902 thereto (that is, connecting the second electrical power source 902 to the second processor-controllable valve 104 so that the second processor-controllable valve 104 may be energized or activated). The second electrical power source 902 is also called a standby electrical power source, such as a 12 volt DC (Direct Current) power source, which may be provided by a solar panel and/or a battery, a rechargeable battery, etc., and any combination thereof. The second processor-controllable valve 104 is also configured to be fluidly connectable (either directly or indirectly) to the outdoor water line 904 (as depicted in any one of FIGS. 3 and 4). The second electrical power source includes a standby electrical power source, including a rechargeable battery.

In accordance with a first option, the controller 106 is configured to receive power from the first electrical power source 900. In accordance with a second option, the controller 106 is configured to receive power from the second electrical power source 902. In accordance with a third option, the controller 106 is configured to receive power from the second electrical power source 902 for the case where the first electrical power source 900 is unavailable for providing electrical power to the controller 106. It will be appreciated that both the first electrical power source 900 and the second electrical power source 902 may be active at the same time (if so desired).

Figure 2B:
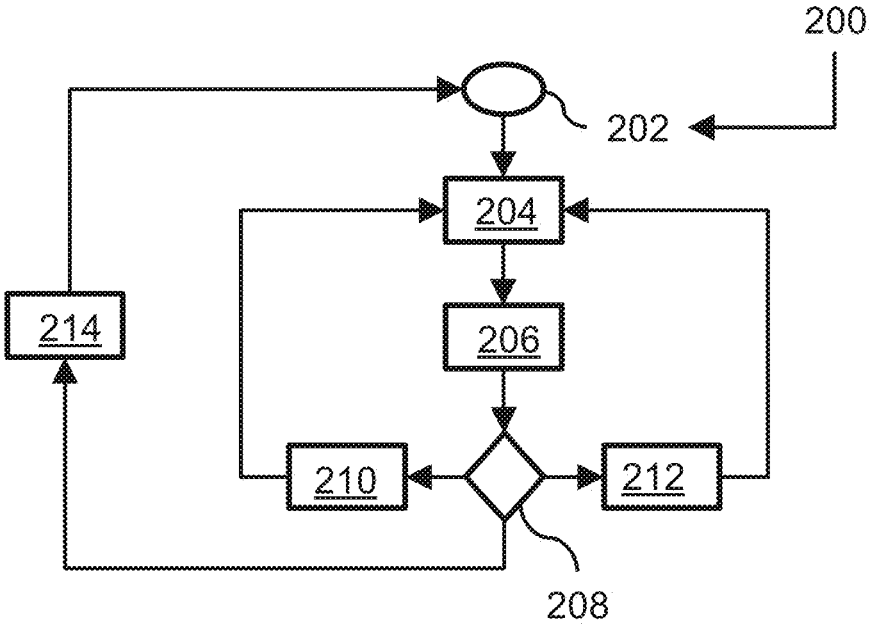
FIG. 2B (SHEET 2 of 4) depicts an embodiment of a control logic schematic (view) of the apparatus of FIG. 1.
Figure 3:
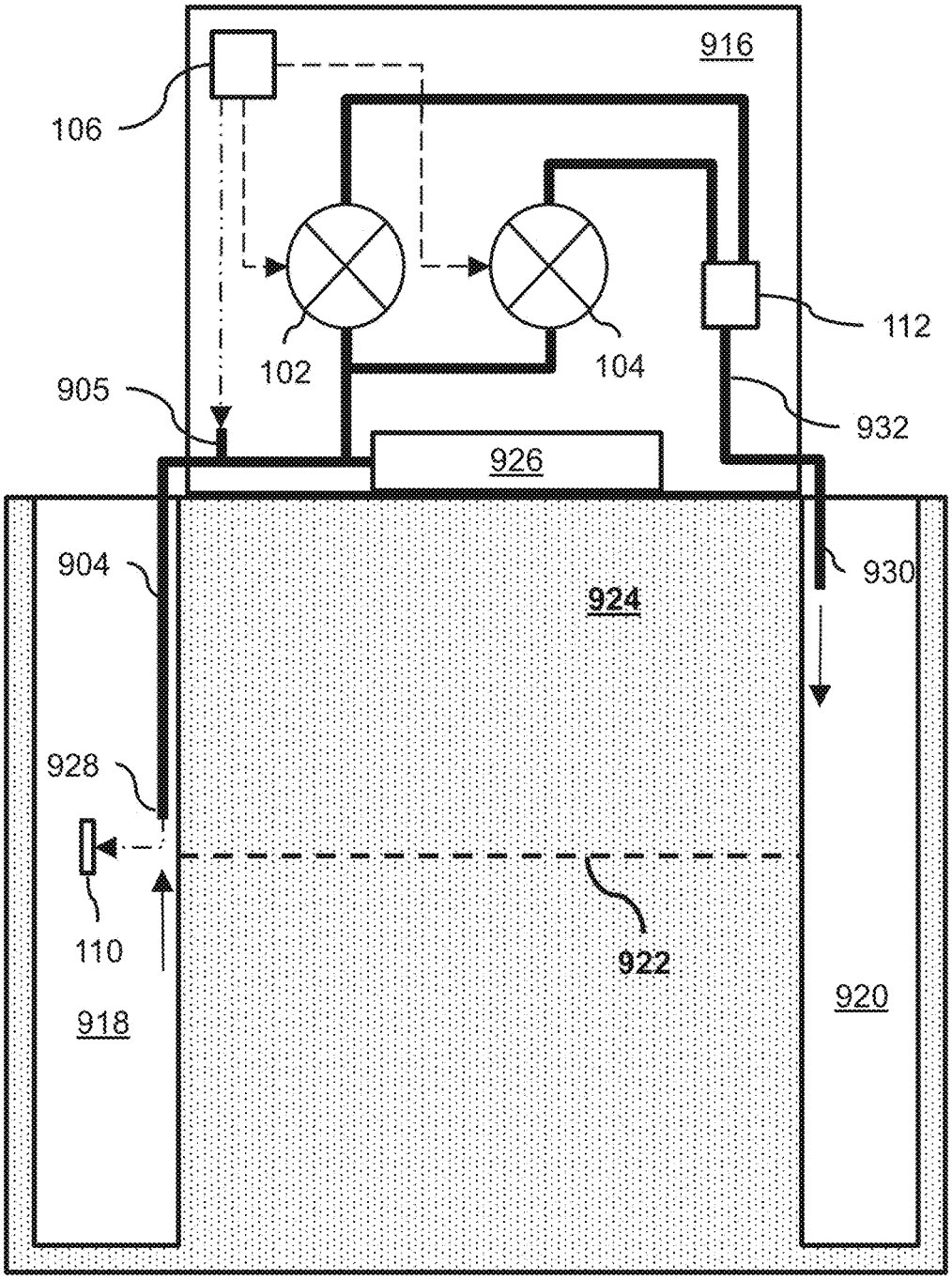
FIG. 3 (SHEET 3 of 4) depicts a first embodiment of a mechanical schematic of the apparatus of FIG. 1.
Figure 4:
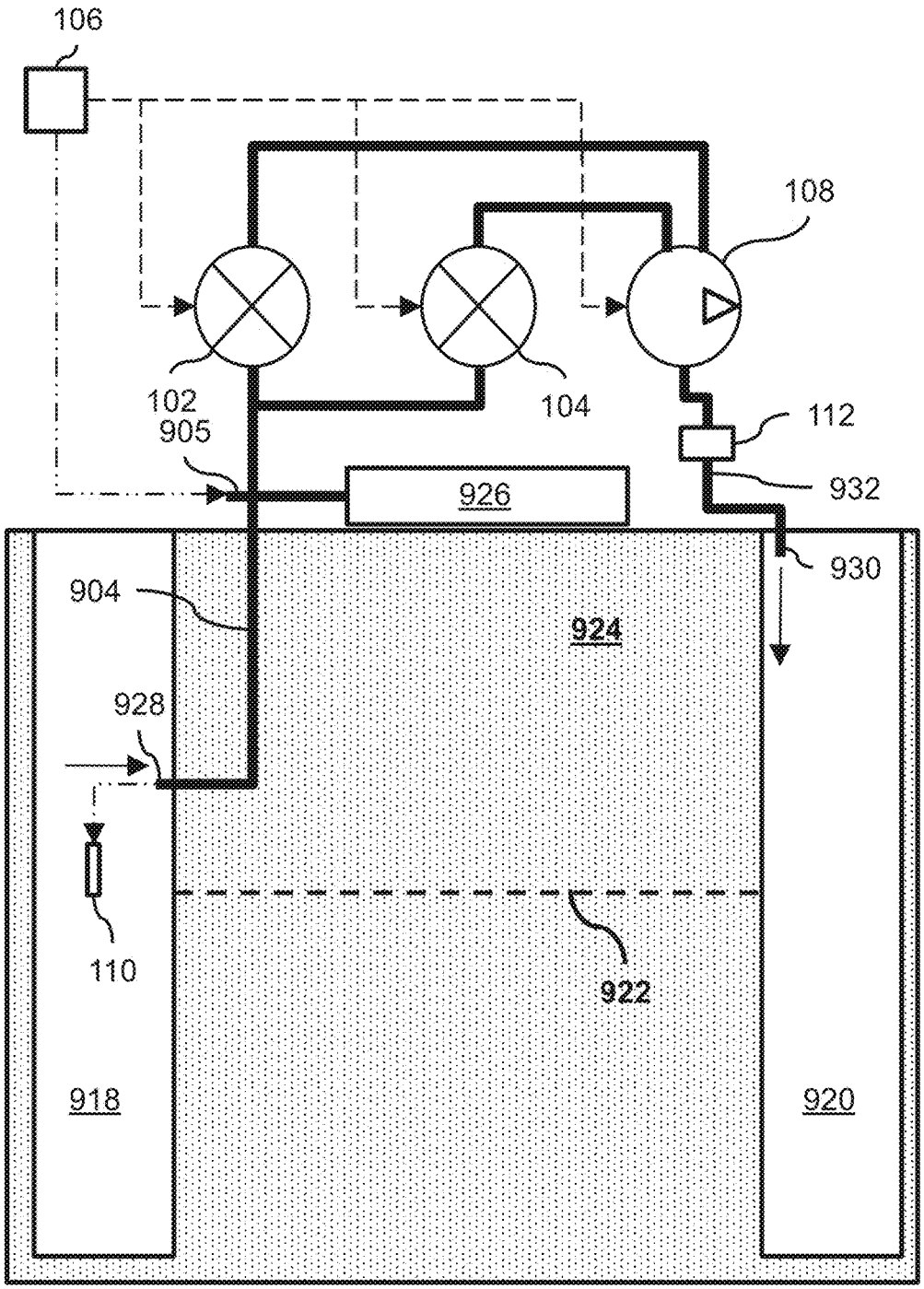
FIG. 4 (SHEET 4 of 4) depicts a second embodiment of a mechanical schematic of the apparatus of FIG. 1.

The controller 106 is configured to be electrically connectable (either directly or indirectly) to a temperature sensor 110 that is positioned proximate to the outdoor water line 904 (as depicted in FIGS. 3 and 4). This is done in such a way that the controller 106, in use, receives a temperature signal from the temperature sensor 110 that is related to the water temperature of the water positioned in the outdoor water line 904. The controller 106 is also configured to determine whether the water positioned in the outdoor water line 904 is reaching the freezing temperature (of water) based on the temperature signal provided by the temperature sensor 110 to the controller 106. The controller 106 includes (and is not limited to) a processor (known and not depicted), a non-transitory computer-readable storage medium (known and not depicted) including processor-executable instructions that, when executed by the processor, cause (urge) the processor to perform various operations (as depicted in FIG. 2B, for instance).

An embodiment of the temperature sensor 110 is configured to be electrically connected to the controller 106. The temperature sensor 110 includes a water proof cable configured to extend or be inserted into the water, a buried pipe (preferably up to about 33 meters or about 100 feet). On the end of the water proof cable (and extended into the water line) is a thermostatic sensor configured to detect water temperatures and relay the information back to the controller 106. The cable may be supplied or is equipped with a connector if so desired.

Preferably, the temperature sensor 110 includes the Model number DS18B20 waterproof digital temperature sensor with a 33 meter cable, manufactured by Shenzhen-Man-Fri-Electronic Technology Co. Ltd.

The controller 106 is also configured to control the operation of the first processor-controllable valve 102, for the case where the controller 106 determines that the water positioned in the outdoor water line 904 is reaching the freezing temperature (of water). This is done in such a way that the controller 106 (in use) urges the first processor-controllable valve 102 to open and permit flow (bleeding) of the water along an interior of the outdoor water line 904 for the case where the first electrical power source 900 is available for use by the first processor-controllable valve 102.

The controller 106 is also configured to control the operation of the second processor-controllable valve 104, for the case where the controller 106 determines that the water positioned in the outdoor water line 904 is reaching the freezing temperature (of water). This is done in such a way that the controller 106 (in use) urges the second processor-controllable valve 104 to open and permit flow (bleeding) of the water along an interior of the outdoor water line 904 for the case where the second electrical power source 902 is available for use by the second processor-controllable valve 104 when the first electrical power source 900 is unavailable for use by the first processor-controllable valve 102.

Utilization of the first electrical power source 900 and of the second electrical power source 902 advantageously provides (improves) operational readiness of the first processor-controllable valve 102 and the second processor-controllable valve 104 at any given time. For instance, for the case where the controller 106 determines that the water positioned in the outdoor water line 904 is reaching the freezing temperature of water, the first processor-controllable valve 102 or the second processor-controllable valve 104 may be activated (by the controller 106) to cause (urge) the flow of water through the outdoor water line 904. In this manner, prevention, at least in part, of the freezing of the water positioned in the interior of the outdoor water line 904 is reduced or avoided. For the case where the first electrical power source 900 fails to provide power for the first processor-controllable valve 102, the controller 106 may activate the second processor-controllable valve 104 to cause water to flow through the outdoor water line 904, etc.

For instance, for the case where the first electrical power source 900 is not available to power the first processor-controllable valve 102, then the controller 106 activates the operation of the second processor-controllable valve 104, which is electrically powered by the second electrical power source 902 (if the second electrical power source 902 is available on a standby basis), for the case where the controller 106 determines that the water positioned in the outdoor water line 904 is reaching the freezing temperature (of water).

In accordance with an embodiment, the apparatus does not further include a standby generator 908 and a standby-generator switch 910, in which case a power grid 906 is electrically connected (either directly or indirectly) to the first electrical power source 900 in such a way that the power grid 906 provides electrical power to the first electrical power source 900.

In accordance with an embodiment, the apparatus further includes a standby generator 908 and a standby-generator switch 910, in which case the power grid 906 is neither directly or nor indirectly electrically connected to the first electrical power source 900. The standby-generator switch 910 is electrically coupled to the power grid 906 (electrical utility lines), to the standby generator 908, and to the first electrical power source 900. The standby generator 908 and the standby-generator switch 910 are known, and therefore are not fully described.

An embodiment of the standby-generator switch 910 includes the Model number 6294 30-amp indoor generator switch (generator transfer switch) manufactured by GENERAC (TRADENAME) based in Wisconsin, United States. An embodiment of the standby generator 908 includes the Model number 6437 generator manufactured by GENERAC (TRADENAME) based in Wisconsin, United States. Preferably, the standby generator 908 is configured to produce a stable stand-by electricity for powering a household, business or institution, and for ensuring steady power to a building to keep the apparatus operating at times when the electrical grid power is not available for utilization by the building. When mains (electric grid) electrical current is not available from the electrical grid, the standby-generator switch 910 is configured to activate to ensure that no power from the secondary system back bleeds to the electrical grid. Within micro seconds, the standby-generator switch 910 is flipped, the standby generator 908 starts and power is restored. If and when traditional electrical grid service is restored, the standby-generator switch 910 is configured to sense power applied to the standby-generator switch 910, the standby-generator switch 910 flips and the standby generator 908 is turned OFF, and electrical power is reverted from the electrical grid to the building and the apparatus. The standby-generator switch 910 is fully automated and does not need human interaction unless a unforeseen mechanical problem occurs.

The standby-generator switch 910 is configured to operate under a first operation mode, in which (A) the standby-generator switch 910 keeps the standby generator 908 electrically isolated from the first electrical power source 900, and (B) the standby-generator switch 910 electrically connects (either directly or indirectly), and maintains electrical connection of, the power grid 906 to the first electrical power source 900 for the case where the power grid 906 is active (that is, the power grid 906 is capable of delivering electrical power), and the standby-generator switch 910 keeps the standby generator 908 electrically isolated from the first electrical power source 900 while the power grid 906 remains active.

The standby-generator switch 910 is configured to operate under a second operation mode, in which (A) the standby-generator switch 910 electrically isolates the power grid 906 from the first electrical power source 900 for the case where the power grid 906 is deactivated (that is, the power grid 906 is not capable of delivering or providing electrical power), and (B) the standby-generator switch 910 electrically connects (either directly or indirectly) the standby generator 908 to the first electrical power source 900, and keeps the power grid 906 electrically isolated from the first electrical power source 900 while the standby generator 908 remains active. Once the power grid 906 becomes active, the standby-generator switch 910 electrically isolates the standby generator 908 from the first electrical power source 900, and electrically connects (either directly or indirectly) the power grid 906 to the first electrical power source 900. At no time whatsoever does the standby-generator switch 910 electrically connects (either directly or indirectly) both the standby generator 908 and the power grid 906 to the first electrical power source 900 (at the same time).

In accordance with an embodiment, the apparatus further includes an automatic reverse voltage switch 914. The automatic reverse voltage switch 914 is electrically connected (either directly or indirectly) to the first electrical power source 900, and to the second electrical power source 902.

The automatic reverse voltage switch 914 is configured to shuttle electrical power between the first electrical power source 900 and the second electrical power source 902 automatically. The automatic reverse voltage switch 914 is much like the generator switch, which ensure power does not bleed back to the electrical grid in case of failure of the standby generator 908. Once traditional hydro (the electrical grid) is not providing power to the building, in most cases the standby generator 908 would kick in, providing the apparatus with electricity. In the off chance of a generator failure, a 12 Volt DC solar array is utilized to provide power to the apparatus. It is necessary to insure that no current from any system is transmitted to the electric grid (utility pole line) to hurt transmission-line workmen. Once the electric utility is down (hydro goes out), the standby-generator switch 910 recognizes loss of power, but if the standby generator 908 will not supply power, than the automatic reverse voltage switch 914 understands the standby generator 908 failed and switches to solar power, and will turn off the solar power system either once the connection to the electrical grid (utility or hydro) is restored or the standby generator 908 is started.

The automatic reverse voltage switch 914 is configured to shuttle electrical power between the first electrical power source 900 and the second electrical power source 902 automatically. In accordance with an embodiment, the apparatus further includes a battery charger 912, and the second electrical power source 902 includes a battery assembly 903. The battery charger 912 is electrically connected (either directly or indirectly) to the battery assembly 903. Preferably, the battery charger 912 includes a solar panel 913 (also called a solar cell) that is installed outdoors.

Preferably, the automatic reverse voltage switch 914 includes the Model number JS-30 (having an ASIN number of B001S3EYT0), and is manufactured by GO POWER! (TRADENAME), located in British Columbia, Canada. The automatic reverse voltage switch 914 is used to hardwire inverters into a system where there is an alternative source of AC. The automatic reverse voltage switch 914 is made to only allow one source of AC power to pass through it to the loads, and may handle 30 amps of service. The automatic reverse voltage switch 914 ensures that the inverter (or solar cell system) does not get damaged if the standby generator 908 or electric grid (utility power) is hooked up while the inverter is running. The automatic reverse voltage switch 914 is much like the generator switch, which ensure power does not bleed back to the electric grid in case of failure of the generator system. Once traditional hydro is lost to the building, in most cases the generator would kick-in, providing the apparatus with electric power. In the off chance of a generator failure, a 12 Volt solar array may be utilized to provide power. The automatic reverse voltage switch 914 insures that no current from any system is transmitted to the electric grid and cause injury to transmission line workmen. Once hydro goes out, the generator switch recognizes loss of power, but if the generator will not supply power, than the automatic reverse voltage switch 914 understands the generator failed and switches to solar power and may turn off the solar system either once electric utility is restored or the generator is started, etc.

Preferably, the inverter includes the Model number SureSine-300 inverter, manufactured by Morning Star Corporation, located in Pennsylvania, USA. The solar power provides voltage to the inverter even in low light to produce enough current to run (operate) the controller 106. The inverter is attached to the controller 106, and is configured to provide 120 volts AC (from a mains panel), or the battery backup may supply the 12 volt DC valve (such as the second processor-controllable valve 104) with optional storage power to open the water secondary 12 volt DC water valve (such as the second processor-controllable valve 104) via solar power for the case where the additional need arises.

The solar panel 913 is electrically connected (either directly or indirectly) to the battery assembly 903. The solar panel 913 is configured to deliver an electrical current to the battery assembly 903. This is done in such a way that the solar panel 913 maintains or increases the charge held by the battery assembly 903. For the case where the first electrical power source 900 is not actively providing electrical power to the automatic reverse voltage switch 914 or to the first processor-controllable valve 102, the automatic reverse voltage switch 914 electrically isolates the second electrical power source 902 from the first electrical power source 900, and the battery assembly 903 of the second electrical power source 902 receives electrical power from the solar panel 913 (in this manner, the controller 106 continues to receive electrical power from the second electrical power source 902 via the battery assembly 903 and the solar panel 913).

Preferably, the solar panel 913 includes Model number SLP 160S-12 solar cell, manufactured by SOLAR LAND (TRADENAME), located in Jiangsu, China.

In accordance with an embodiment, the battery charger 912 further includes an electrical transformer 915 (known and not further described) that is installed indoors. The electrical transformer 915 is configured to charge the battery assembly 903. The electrical transformer 915 electrically connects (either directly or indirectly) the automatic reverse voltage switch 914 to the battery assembly 903. This is done in such a way that the electrical transformer 915 provides a trickle charge to the battery assembly 903 (while the automatic reverse voltage switch 914 receives electrical power from the first electrical power source 900). The solar panel 913 and the electrical transformer 915 provide back-up for each other in case one or the other is not operational (so that the battery assembly 903 may maintain a suitable electrical charge for the case where the first electrical power source 900 (in use) cannot provide electrical power to the automatic reverse voltage switch 914).

In accordance with an embodiment, the apparatus further includes a water pump 108 (also depicted in FIG. 4) that is fluidly coupled to the outdoor water line 904. The water pump 108 is controllable by the controller 106. Preferably, the water pump 108 is controllable by the controller 106 in such a way that once the controller 106 (in use) turns ON any one of the first processor-controllable valve 102 and the second processor-controllable valve 104, the water pump 108 is turned ON to provide flow assistance for urging the water in the outdoor water line 904 to flow. For the case where the internal pressure in the outdoor water line 904 is less than 35 PSI (pounds per square inch), then the water pump 108 is connected (as depicted in FIG. 4). For the case where the internal pressure in the outdoor water line 904 is greater than or equal to about 35 PSI, it will be appreciated that this is preferred to utilize gravity feed (gravity-induced flow) of water through the outdoor water line 904, in which case the water pump 108 is then not required.

Preferably, the water pump 108 includes the Model number PS-C22 submersible pump (combo sump pump system), manufactured by PRO SERIES (TRADENAME), and located in Illinois, USA. Preferably, the water pump 108 includes a dual voltage sump pump for use with the apparatus, and is configured to discharge water coming through the water line. The water pump 108 is configured to operate using a traditional power source or with to a solar back-up system utilizing the inverter or from power supplied by a storage battery (optional, if so desired).

In summary, the controller 106 is configured to determine whether the water positioned in the outdoor water line 904 is reaching the freezing temperature (of water). In addition, the controller 106 is also configured to control the operation of the first processor-controllable valve 102 and the second processor-controllable valve 104 depending on whether the first electrical power source 900 is available and whether the water positioned in the outdoor water line 904 has reached the freezing temperature of water.

Figure 2A:
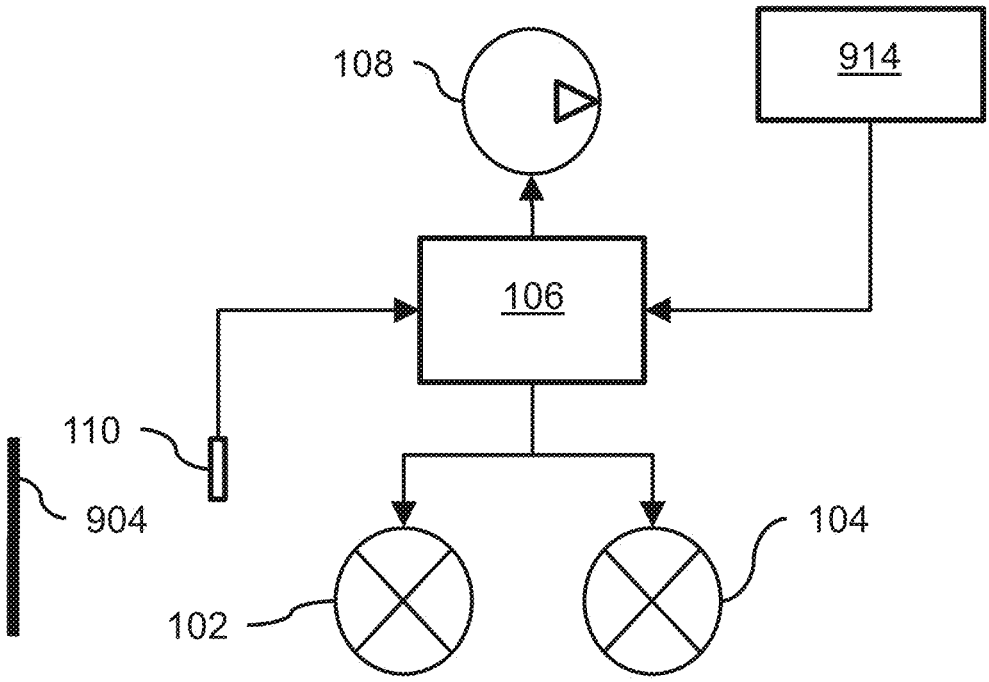
FIG. 2A (SHEET 2 of 4) depicts an embodiment of an electrical control schematic of the apparatus of FIG. 1.

FIG. 2A depicts an embodiment of an electrical control schematic (view) of the apparatus of FIG. 1.

The controller 106 is configured to be electrically connectable (either directly or indirectly) to the temperature sensor 110. The temperature sensor 110 is positioned proximate to the outdoor water line 904 (as depicted in FIGS. 3 and 4). This is done in such a way that the controller 106, in use, receives a temperature signal from the temperature sensor 110 that is related to the water temperature of the water positioned in the outdoor water line 904.

The controller 106 is also configured to determine whether the water positioned in the outdoor water line 904 is reaching (or has reached) the freezing temperature (of water) based on the temperature signal provided by the temperature sensor 110 to the controller 106.

Once the controller 106 has determined that the water positioned in the outdoor water line 904 is reaching (or has reached) the freezing temperature (of water), then the controller 106 (in use) turns ON the first processor-controllable valve 102. However, if the first processor-controllable valve 102 is unable to respond (because the first electrical power source 900 (in use) cannot provide electrical power to the first processor-controllable valve 102), then the controller 106 (in use) turns ON the second processor-controllable valve 104 (the second processor-controllable valve 104 is powered by the second electrical power source 902).

For instance, in order for the controller 106 to determine that the first electrical power source 900 is available or not available, the controller 106 is configured to receive an indication from the automatic reverse voltage switch 914 regarding the activity status of the first electrical power source 900. For the case where the automatic reverse voltage switch 914 indicates that first electrical power source 900 is not active, the controller 106 (in use) turns ON the second processor-controllable valve 104 (when required to prevent the freezing of water in the outdoor water line 904). For the case where the automatic reverse voltage switch 914 indicates that the first electrical power source 900 is active, the controller 106 (in use) turns ON the first processor-controllable valve 102 (when required to prevent the freezing of water in the outdoor water line 904).

FIG. 2B depicts an embodiment of a control logic schematic (view) of the apparatus of FIG. 1.

The control logic (a control method 200) of the controller 106 includes various control operations (as depicted in FIG. 2B).

A first control operation 202 includes the controller 106 starting the control method 200. Program control is transferred to a second control operation 204.

The second control operation 204 includes the controller 106 receiving a temperature signal from the temperature sensor 110, and determining whether the temperature signal is above or below a threshold temperature proximate to and above the freezing temperature of water. Program control is transferred to a third control operation 206.

The third control operation 206 includes the controller 106 receiving an activity status of the first electrical power source 900 from the automatic reverse voltage switch 914, and determining whether the first electrical power source 900 is active or not active. Program control is transferred to a fourth control operation 208.

The fourth control operation 208 includes the controller 106 determining whether to turn ON the first processor-controllable valve 102 or the second processor-controllable valve 104 based on the information derived from the second control operation 204 and the third control operation 206. For the case where the controller 106 determines that the water temperature is below the threshold temperature, and the activity status of the first electrical power source 900 is ACTIVE, then program control is transferred to a fifth control operation 210. For the case where the controller 106 determines that the water temperature is below the threshold temperature, and the activity status of the first electrical power source 900 is INACTIVE, then program control is transferred to a sixth control operation 212. For the case where the controller 106 determines that the water temperature is above the threshold temperature, then program control is transferred to a seventh control operation 214.

The fifth control operation 210 includes the controller 106 turning ON the first processor-controllable valve 102. Program control is transferred to the second control operation 204.

The sixth control operation 212 includes the controller 106 turning ON the second processor-controllable valve 104. Program control is transferred to the second control operation 204.

The seventh control operation 214 includes the controller 106 turning OFF the first processor-controllable valve 102 and the second processor-controllable valve 104 (because the water temperature is above the threshold temperature). Program control is transferred to the first control operation 202.

FIG. 3 depicts a first embodiment of a mechanical schematic of the apparatus of FIG. 1.

In accordance with an embodiment, the first processor-controllable valve 102, the second processor-controllable valve 104 and the controller 106 are positioned in an interior of a building 916 (such as, a home or cottage, etc.).

The outdoor water line 904 includes a water outlet 930 that is positioned in a water drain 920, such as a dry ditch, a ditch, a sewer, etc. The outdoor water line 904 includes a water inlet 928 that is positioned in a water source 918, such as a well, a lake, etc. The outdoor water line 904 extends from the water source 918 to the surface (ground surface) and into the building 916. Preferably, the water inlet 928 is positioned above the frost line 922 that is formable in the soil 924.

The temperature sensor 110 is positioned proximate to the water inlet 928 (preferably in the water source 918 and proximate to the water inlet 928). A control line extends between the temperature sensor 110 and the controller 106 via the interior of the outdoor water line 904. The control line enters a portal 905 of the outdoor water line 904, and exits from the water inlet 928.

The outdoor water line 904 is fluidly connected (either directly or indirectly) to the house plumbing 926. The outdoor water line 904 is fluidly connected (either directly or indirectly) to an inlet of the first processor-controllable valve 102 and to an inlet of the second processor-controllable valve 104. An outlet of the first processor-controllable valve 102 is fluidly connected (either directly or indirectly) to the water drain 920 (via a drain pipe 932). An outlet of the second processor-controllable valve 104 is fluidly connected (either directly or indirectly) to the water drain 920 (via the drain pipe 932).

In accordance with an embodiment, a water meter 112 is utilized, in which the outlet of the first processor-controllable valve 102 is fluidly connected (either directly or indirectly) to an inlet of the water meter 112, and the outlet of the second processor-controllable valve 104 is fluidly connected (either directly or indirectly) to the inlet of the water meter 112. An outlet of the water meter 112 is fluidly connected (either directly or indirectly) to the water drain 920 (via the drain pipe 932). The water meter 112 is configured to measure an amount of water flowing through any one of the first processor-controllable valve 102 and the second processor-controllable valve 104. The water meter 112 is configured to measure the amount of water that is removed from the outdoor water line 904.

Preferably, the water meter 112 includes the Model number High Quality Water Meter Flow gauge, manufactured by POWOGAZ (TRADENAME), located in Poznan, Poland. Preferably, the water meter 112 keeps continuous and accurate account of the water that is dumped from the water supply intake line (from the building to the waste disposal site or other disposal site, etc.). The water meter 112 allows the re-reimbursement of the total accumulated water volume on metered town water supply system that was required to keep the water supply system from freezing up. As water flows through the water meter 112, a display shows what water has been wasted during the operation of the apparatus.

FIG. 4 depicts a second embodiment of a mechanical schematic of the apparatus of FIG. 1.

It will be appreciated that the building 916 of FIG. 3 is not depicted in FIG. 4, for improved or convenient viewing of the embodiment as depicted in FIG. 4. In accordance with an embodiment, the outdoor water line 904 is buried, at least in part, in the soil 924.

It will be appreciated that the description and/or drawings identify and describe embodiments of the apparatus (either explicitly or non-explicitly). The apparatus may include any suitable combination and/or permutation of the technical features as identified in the detailed description, as may be required and/or desired to suit a particular technical purpose and/or technical function. It will be appreciated, that where possible and suitable, any one or more of the technical features of the apparatus may be combined with any other one or more of the technical features of the apparatus (in any combination and/or permutation). It will be appreciated that persons skilled in the art would know that technical features of each embodiment may be deployed (where possible) in other embodiments even if not expressly stated as such above. It will be appreciated that persons skilled in the art would know that other options would be possible for the configuration of the components of the apparatus to adjust to manufacturing requirements and still remain within the scope as described in at least one or more of the claims. This written description provides embodiments, including the best mode, and also enables the person skilled in the art to make and use the embodiments. The patentable scope may be defined by the claims. The written description and/or drawings may help understand the scope of the claims. It is believed that all the crucial aspects of the disclosed subject matter have been provided in this document. It is understood, for this document, that the phrase "includes" is equivalent to the word "comprising." The foregoing has outlined the non-limiting embodiments (examples). The description is made for particular non-limiting embodiments (examples). It is understood that the non-limiting embodiments are merely illustrative as examples.

What is claimed is:

1. An apparatus, comprising:

a first processor-controllable valve being configured to be operative in response to controlled application of a first electrical power source thereto; and the first processor-controllable valve also being configured to be fluidly connectable to an outdoor water line, in which the outdoor water line is configured to convey water therealong; and a second processor-controllable valve being configured to be operative in response to controlled application of a second electrical power source thereto; and the second processor-controllable valve also being configured to be fluidly connectable to the outdoor water line; and a controller being configured to be electrically connectable to a temperature sensor being positioned proximate to the outdoor water line in such a way that the controller, in use, receives a temperature signal from the temperature sensor that is related to the temperature of the water positioned in the outdoor water line; and the controller also being configured to determine whether the water positioned in the outdoor water line is reaching the freezing temperature of water based on the temperature signal provided by the temperature sensor to the controller; and the controller also being configured to control operation of the first processor-controllable valve, for the case where the controller determines that the water positioned in the outdoor water line is reaching the freezing temperature of water, in such a way that the controller, in use, urges the first processor-controllable valve to open and permit flow of the water along an interior of the outdoor water line for the case where the first electrical power source is available for use by the first processor-controllable valve; and the controller also being configured to control operation of the second processor-controllable valve, for the case where the controller determines that the water positioned in the outdoor water line is reaching the freezing temperature of water, in such a way that the controller, in use, urges the second processor-controllable valve to open and permit flow of the water along an interior of the outdoor water line for the case where the second electrical power source is available for use by the second processor-controllable valve when the first electrical power source is unavailable for use by the first processor-controllable valve; and an outlet of the first processor-controllable valve is fluidly connected to an inlet of a water meter; and an outlet of the second processor-controllable valve is fluidly connected to the inlet of the water meter; and an outlet of the water meter is fluidly connected to a water drain; and the water meter is configured to measure an amount of water flowing through any one of the first processor-controllable valve and the second processor-controllable valve.

2. The apparatus of claim 1, wherein:

the first processor-controllable valve includes a primary processor-controllable valve; and the first electrical power source includes a 120 volt AC mains power panel; and the second processor-controllable valve includes a standby processor-controllable valve; and the second electrical power source includes a standby electrical power source, including a rechargeable battery.

3. The apparatus of claim 1, wherein:

the controller is configured to receive power from the second electrical power source.

4. The apparatus of claim 1, wherein:

for the case where the first electrical power source is not available to power the first processor-controllable valve, and where the controller determines that the water positioned in the outdoor water line is reaching the freezing temperature of water, the controller is configured to activate operation of the second processor-controllable valve, which is electrically powered by the second electrical power source.

5. The apparatus of claim 1, wherein:

a standby-generator switch is electrically coupled to a power grid, to a standby generator, and to the first electrical power source.

6. The apparatus of claim 1, wherein:

an automatic reverse voltage switch is electrically connected to the first electrical power source, and to the second electrical power source; and the automatic reverse voltage switch is configured to shuttle electrical power between the first electrical power source and the second electrical power source automatically.

7. The apparatus of claim 1, wherein:

the second electrical power source includes a battery assembly; and a battery charger is electrically connected to the battery assembly.

8. The apparatus of claim 7, wherein:

the battery charger includes a solar panel that is electrically connected to the battery assembly.

9. The apparatus of claim 8, wherein:

the battery charger further includes an electrical transformer configured to charge the battery assembly.

10. The apparatus of claim 1, wherein:

once the controller has determined that the water positioned in the outdoor water line is reaching the freezing temperature of water, the controller, in use, turns ON the first processor-controllable valve; and the controller, in use, turns ON the second processor-controllable valve, wherein the second processor-controllable valve is powered by the second electrical power source if the first processor-controllable valve is unable to respond because the first electrical power source, in use, cannot provide electrical power to the first processor-controllable valve.

11. The apparatus of claim 1, wherein:

in order for the controller to determine that the first electrical power source is available or not available, the controller is configured to receive an indication regarding an activity status of the first electrical power source; and for the case where the first electrical power source is not active, the controller, in use, turns ON the second processor-controllable valve when required to prevent freezing of water in the outdoor water line; and for the case where the first electrical power source is active, the controller, in use, turns ON the first processor-controllable valve when required to prevent freezing of water in the outdoor water line.

12. The apparatus of claim 1, wherein:

the outdoor water line includes a water outlet that is positioned in a water drain; and the outdoor water line includes a water inlet that is positioned in a water source; and the outdoor water line extends from the water source to a ground surface and into a building.

13. The apparatus of claim 1, wherein:

the outdoor water line includes a water outlet that is positioned in a water drain; and the outdoor water line includes a water inlet that is positioned in a water source; and the outdoor water line extends from the water source to a ground surface and into a building.

14. The apparatus of claim 1, wherein:

the outdoor water line includes a water outlet that is positioned in a water drain; and the outdoor water line includes a water inlet that is positioned in a water source; and the outdoor water line is buried, at least in part, in the soil.

15. The apparatus of claim 1, wherein:

the temperature sensor is positioned proximate to a water inlet of the outdoor water line.

16. The apparatus of claim 1, wherein:

a water pump is fluidly coupled to the outdoor water line; and the water pump is controllable by the controller in such a way that once the controller, in use, turns ON any one of the first processor-controllable valve and the second processor-controllable valve, the water pump is turned ON to provide flow assistance for urging the water in the outdoor water line to flow.

17. The apparatus of claim 16, wherein:

a control line extends between the temperature sensor and the controller via the interior of the outdoor water line; and the control line enters a portal of the outdoor water line, and exits from a water inlet.

18. An apparatus, comprising:

a first processor-controllable valve being configured to be operative in response to controlled application of a first electrical power source thereto; and the first processor-controllable valve also being configured to be fluidly connectable to an outdoor water line, in which the outdoor water line is configured to convey water therealong; and a second processor-controllable valve being configured to be operative in response to controlled application of a second electrical power source thereto; and the second processor-controllable valve also being configured to be fluidly connectable to the outdoor water line; and a controller being configured to be electrically connectable to a temperature sensor being positioned proximate to the outdoor water line in such a way that the controller, in use, receives a temperature signal from the temperature sensor that is related to the temperature of the water positioned in the outdoor water line; and the controller also being configured to determine whether the water positioned in the outdoor water line is reaching the freezing temperature of water based on the temperature signal provided by the temperature sensor to the controller; and the controller also being configured to control operation of the first processor-controllable valve, for the case where the controller determines that the water positioned in the outdoor water line is reaching the freezing temperature of water, in such a way that the controller, in use, urges the first processor-controllable valve to open and permit flow of the water along an interior of the outdoor water line for the case where the first electrical power source is available for use by the first processor-controllable valve; and the controller also being configured to control operation of the second processor-controllable valve, for the case where the controller determines that the water positioned in the outdoor water line is reaching the freezing temperature of water, in such a way that the controller, in use, urges the second processor-controllable valve to open and permit flow of the water along an interior of the outdoor water line for the case where the second electrical power source is available for use by the second processor-controllable valve when the first electrical power source is unavailable for use by the first processor-controllable valve; and a water pump is fluidly coupled to the outdoor water line; and the water pump is controllable by the controller in such a way that once the controller, in use, turns ON any one of the first processor-controllable valve and the second processor-controllable valve, the water pump is turned ON to provide flow assistance for urging the water in the outdoor water line to flow.

19. The apparatus of claim 18, wherein:

a control line extends between the temperature sensor and the controller via the interior of the outdoor water line; and the control line enters a portal of the outdoor water line, and exits from a water inlet.

20. An apparatus, comprising:

a first processor-controllable valve being configured to be operative in response to controlled application of a first electrical power source thereto; and the first processor-controllable valve also being configured to be fluidly connectable to an outdoor water line, in which the outdoor water line is configured to convey water therealong; and a second processor-controllable valve being configured to be operative in response to controlled application of a second electrical power source thereto; and the second processor-controllable valve also being configured to be fluidly connectable to the outdoor water line; and a controller being configured to be electrically connectable to a temperature sensor being positioned proximate to the outdoor water line in such a way that the controller, in use, receives a temperature signal from the temperature sensor that is related to the temperature of the water positioned in the outdoor water line; and the controller also being configured to determine whether the water positioned in the outdoor water line is reaching the freezing temperature of water based on the temperature signal provided by the temperature sensor to the controller; and the controller also being configured to control operation of the first processor-controllable valve, for the case where the controller determines that the water positioned in the outdoor water line is reaching the freezing temperature of water, in such a way that the controller, in use, urges the first processor-controllable valve to open and permit flow of the water along an interior of the outdoor water line for the case where the first electrical power source is available for use by the first processor-controllable valve; and the controller also being configured to control operation of the second processor-controllable valve, for the case where the controller determines that the water positioned in the outdoor water line is reaching the freezing temperature of water, in such a way that the controller, in use, urges the second processor-controllable valve to open and permit flow of the water along an interior of the outdoor water line for the case where the second electrical power source is available for use by the second processor-controllable valve when the first electrical power source is unavailable for use by the first processor-controllable valve; and a control line extends between the temperature sensor and the controller via the interior of the outdoor water line; and the control line enters a portal of the outdoor water line, and exits from a water inlet.

* * * * *